US007668442B2

(12) United States Patent
O'Neill

(10) Patent No.: US 7,668,442 B2
(45) Date of Patent: Feb. 23, 2010

(54) APPARATUS FOR PROVIDING A VISUAL EFFECT

(75) Inventor: Noel O'Neill, Co Louth (IE)

(73) Assignee: Basic Holdings, Dublin (IE)

( * ) Notice: Subject to any disclaimer, the term of this patent is extended or adjusted under 35 U.S.C. 154(b) by 0 days.

(21) Appl. No.: 10/528,711

(22) PCT Filed: Sep. 19, 2003

(86) PCT No.: PCT/EP03/10465

§ 371 (c)(1),
(2), (4) Date: Oct. 18, 2005

(87) PCT Pub. No.: WO2004/027321

PCT Pub. Date: Apr. 1, 2004

(65) Prior Publication Data

US 2006/0153547 A1 Jul. 13, 2006

(30) Foreign Application Priority Data

Sep. 19, 2002 (GB) ..... 0221728.9
Jun. 6, 2003 (GB) ..... 0313057.2

(51) Int. Cl.
*F24B 1/18* (2006.01)
*F24C 15/06* (2006.01)

(52) U.S. Cl. ..... 392/348; 40/428; 472/65

(58) Field of Classification Search ..... 392/348; 40/428; 362/96, 253, 806; 472/65; 454/248
See application file for complete search history.

(56) References Cited

U.S. PATENT DOCUMENTS 2,984,032 A * 5/1961 Cornell ..... 40/428
3,526,984 A * 9/1970 Nielsen et al. ..... 40/428
3,742,189 A * 6/1973 Conroy et al. ..... 392/348
4,965,707 A * 10/1990 Butterfield ..... 362/96
5,334,818 A * 8/1994 Edwards et al. ..... 219/539
5,425,126 A * 6/1995 Lee ..... 392/364
6,034,354 A * 3/2000 Hironaka ..... 219/383
6,269,567 B1 * 8/2001 MacPherson et al. ..... 40/428
6,363,636 B1 * 4/2002 Hess et al. ..... 40/428
6,564,485 B1 5/2003 Hess
6,802,361 B2 * 10/2004 Hatanaka ..... 165/53

FOREIGN PATENT DOCUMENTS

EP 0 611 921 9/1999
GB 2276444 A * 9/1994
GB 2298073 8/1996
GB 2372807 9/2002
JP 06290762 A * 10/1994

OTHER PUBLICATIONS

International Search Report for PCT/EP 03/10465; Date of Mailing Feb. 2, 2004.

* cited by examiner

*Primary Examiner*—Stephen J Ralis
(74) *Attorney, Agent, or Firm*—Myers Bigel Sibley & Sajovec

(57) ABSTRACT

An apparatus for simulating flames includes a light source, a viewing screen capable of diffusing and transmitting light, a rear reflector disposed behind the viewing screen, and a light producer for producing moving beams of light. The light source is disposed below the reflector and behind the viewing screen. The light producer is disposed in front of the light source and below the screen and light from the light source is reflected by the light producer onto the reflector and is reflected by the reflector onto the screen to produce a perceptible image viewable on the screen.

15 Claims, 4 Drawing Sheets

APPARATUS FOR PROVIDING A VISUAL EFFECT

RELATED APPLICATIONS

The present application is a 35 U.S.C. §371 national phase application of PCT International Application No. PCT/EP03/010465, having an international filing date of Sep. 19, 2003, and claiming priority to Great Britain Patent Application Nos. 0221728.9, filed Sep. 19, 2002, and 0313057.2, filed Jun. 6, 2003, the disclosures of which are incorporated herein by reference in their entireties. The above PCT International Application was published in the English language and has International Publication No. WO 2004/027321 A1.

BACKGROUND

The present invention relates to apparatus for simulating flames, such as are used in flame effect electric heating appliances (i.e. electric fires). Flame simulating apparatus in general are well known and have been described in, for example, GB 2 230 335 and GB 2 275 105. Prior art apparatus such as described in the above patents is intended for use in an electric fire located in a conventional fireplace. As such, the fire is designed so that the fire is supported on a floor with a major part of the fire fitting into the recess of the fireplace. Therefore, the overall depth of the fire (i.e. its front-to-back dimension) can be relatively great.

SUMMARY OF EMBODIMENTS OF THE INVENTION

The present invention seeks to provide an apparatus which has an equivalent or superior flame simulating effect, primarily for use in an electric fire, but which is suitable for mounting directly on a wall, that is, without the need for any sort of recess in the wall to accommodate the apparatus and most preferably with the apparatus spaced apart from (i.e. located above) the floor of the room. In order to achieve such an apparatus which is commercially and practically acceptable, the apparatus of the present invention is constructed to have a depth which is considerably less than conventional apparatus.

According to a first aspect of the invention there is provided a flame simulating apparatus comprising i) a light source;

ii) a viewing screen capable of diffusing and transmitting light, iii) a rear reflecting means disposed behind the viewing screen;

iv) means for producing moving beams of light; wherein the light source is disposed below the rear reflecting means and behind the viewing screen, the means for producing moving beams of light is disposed in front of the light source and below the screen and light from the light source is reflected by the means for producing moving beams of light onto the rear reflecting means and is reflected by the rear reflecting means onto the screen to produce a perceptible image viewable on the screen, and wherein the light source comprises at least one light bulb having a diameter of not more than about 40 mm.

According to a second aspect of the invention, there is provided a flame effect electric fire comprising:

i) a housing adapted to be mounted on a substantially plane wall;

ii) heating means disposed in the housing operative to draw air into the housing, heat the air and expel the heated air; and iii) a flame simulating assembly mounted in the housing and comprising:

(a) a light source;

(b) a viewing screen capable of diffusing and transmitting light;

(c) a rear reflecting means disposed behind the viewing screen; and (d) means for producing moving beams of light, wherein the light source is disposed below the rear reflecting means and behind the viewing screen, the means for producing moving beams of light is disposed in front of the light source and below the screen and light from the light source is reflected by the means for producing moving beams of light onto the rear reflecting means and is reflected by the rear reflecting means onto the screen to produce a perceptible image viewable on the screen, and wherein the heating means draws in and expels air through a downwardly facing external panel of the housing.

Most preferably in these aspects of the invention, light from the light source is prevented from falling directly onto the viewing screen by means of a baffle mounted above the light source. Preferably also the amount of light transmitted from the light source via the means for producing moving beams of light is maximised by providing an additional reflector mounted (with respect to the means for producing moving beams of light) behind the light source. Because of the limited available depth (front to back dimension) of the apparatus, the aperture through which light must pass (after reflection from the means for producing moving beams of light) in order to strike the additional reflector is necessarily constrained in its size which limits the amount of light which can be transmitted. Provision of the additional reflector maximises the amount of light passing through this aperture and so enables a light source of relatively lower power to be used than would otherwise be the case. Using a light source of relatively lower power is, of course, advantageous in that a physically smaller light source can be used.

Advantageously in these aspect of the invention the light source comprises at least one halogen bulb. Provision of the additional reflector permits, however, lower power and cheaper standard bulbs, such as tungsten filament bulbs to be used.

Most preferably in the first and second aspects of the invention the light source has a width of not more than about 20 mm, typically not more than about 15 mm, for example in the range of 13 to 15 mm.

In a particularly preferred embodiment of both aspects of the invention, the means for producing moving beams of light comprises a shaft mounted substantially horizontally for rotation about its axis, said shaft having a plurality of outwardly (e.g. generally radially) directed pieces of reflective material depending therefrom, said pieces being effective to reflect light from the light source onto the screen. Thus light from the light source striking the pieces of reflective material is reflected by those pieces. Because the pieces of reflective material are rotating about the shaft, the light is reflected at constantly changing angles (since effectively the angle of incidence of the light on the pieces of reflective material is constantly changing). This causes light reflected from the pieces of reflective material, after further reflection by the rear reflecting means to trace a path up the screen, giving the appearance of moving flames. The pieces of reflective material are preferably non-planar to further vary the angle of reflection of the light and to contribute to a random appearance of the flame-like image on the screen.

In a further embodiment of both aspects of the invention, the shaft is driveably connected at its first end to a drive means (such as a motor) for rotation of the shaft and is retained at its second end in a supporting bracket, the shaft being displaceable from its operative position thereby to permit access to the light source. In this way, a facility is provided for a user to change the light bulbs forming the light source if the bulbs fail.

According to a third aspect of the invention there is provided an apparatus for producing a visual effect (in particular for simulating flames) comprising:

i) a light source;

ii) a viewing screen capable of diffusing and transmitting light, iii) means for producing moving beams of light, wherein:

a) light from the light source is reflected by the means for producing moving beams of light, either directly or indirectly, onto the viewing screen to produce a perceptible image viewable on the screen; and b) the means for producing moving beams of light comprises a shaft mounted for rotation about its axis and having a reflective material mounted thereon for reflecting light from the light source, the shaft is driveably connected at its first end to a drive means operative to rotate the shaft and is retained at its second end in a supporting bracket, the shaft being displaceable from its operative position thereby to permit access to the light source.

In preferred embodiments the shaft is connected to the drive means via a flexible drive-transmitting bushing and the second end of the shaft is releasably mounted in the bracket, the shaft being displaceable when desired by flexure of the flexible bushing. Thus, in order to change a bulb of the light source, a user simply needs to release the second end of the shaft from its mounting and draw the second end of the shaft forwards causing the bushing at the first end to bend. Access to the bulb or bulbs is then possible and when the bulb has been changed, the second end of the shaft can be re-mounted in its bracket.

In a further preferred embodiment of each aspect of the invention the rear reflecting means comprises a sheet of material having reflecting regions and non-reflecting regions. The reflecting regions may be generally flame shaped. The reflecting and non-reflecting regions may be formed by any suitable means such as treating a sheet of reflective material to make regions thereof matte, or attaching shaped pieces of reflective material to a dull or matte backing substrate.

The reflecting surface of the rear reflecting means may be curved or bowed, for example part cylindrical.

In preferred arrangements of each aspect of the invention, a simulated fuel bed is disposed directly in front of the diffusing and transmitting screen. Preferably the screen comprises a reflective front surface whereby a reflection of the fuel bed can be seen in the screen. In this way, the simulated flames (i.e. the image) in the screen appear behind the simulated fuel bed and in front of its reflection, so that the flames appear to emanate from the middle of a combined fuel bed comprising the simulated fuel bed and its reflection.

BRIEF DESCRIPTIONS OF THE DRAWINGS

For a better understanding of the invention and to show how the same may be carried into effect, reference will be made by way of example only to the following drawings in which.

DESCRIPTION OF EMBODIMENTS ACCORDING TO THE INVENTION

Figure 1:
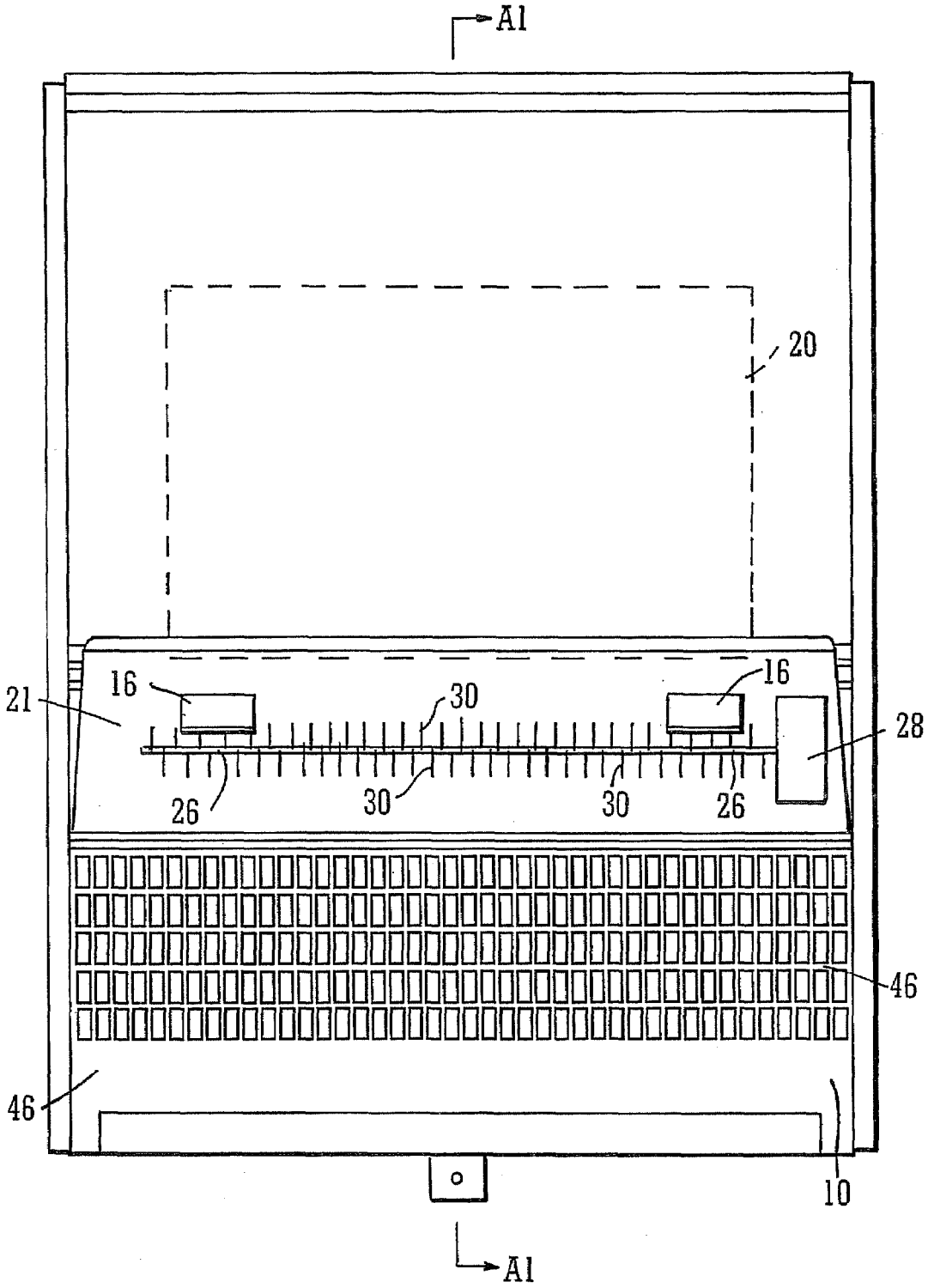
FIG. 1 is a front plan view of a partly disassembled fire according to the invention.

Referring now to the drawings the fire comprises a housing 10 preferably of metal having a front frame 12. The housing retains a protective screen 14 of a suitable optically transparent material, preferably a glass or possibly plastic material through which the flame simulating arrangement of the fire can be viewed. The screen 14 has been removed in the view shown in FIG. 1. The protective screen does not form part of the flame simulating arrangement and serves primarily to enclose the flame simulating components to prevent the ingress of dust, for example.

The flame simulating arrangement of the illustrated fire comprises a light source 16, means 18 for modifying the light from the light source 16 to provide the appearance of movement (also referred to as a "means for producing moving beams of light"), a rear reflecting means 20, and a viewing screen 22. The fire of the invention preferably further comprises a simulated fuel bed 24 (not shown in FIG. 1) which may be formed from a plastic material moulded in to a suitable shape and suitably coloured to represent pieces of solid fuel (such as coal or logs) resting on an ember bed. The fuel bed 24 is illuminated from below by the light source 16. Preferably the light from the light source 16 is modified by the means 18 so that the intensity of the light falling on different parts of the fuel bed 24 varies in an apparently random manner, simulating the changing intensity of light from glowing embers. A baffle 16*a* is provided above the light source 16 to substantially prevent light from the light source 16 from falling directly onto the screen 22.

The means 18 for modifying the light from the light source 16 preferably comprises a shaft 26 which is mounted essentially horizontally in use. The shafted is rotated about its axis by a motor 28. Depending from the shaft 26 is a plurality of pieces of reflective material 30. These pieces 30 may be of metal, metal foil, metallised plastic or the like and are preferably arranged to extend generally radially from the shaft 26. The pieces 30 need not lie exactly radially and considerable variance from an exact radial alignment is acceptable. The individual pieces 30 may be planar or may be twisted. Light from the light source 16 strikes the pieces 30 as they rotate about the shaft 26 and is reflected by the pieces 30 towards the reflecting means 20 and towards the underside of the fuel bed 24. The rotation of the pieces 30 about the shaft 26 causes the light from the light source 16 to be reflected at constantly changing angles with respect to a vertical plane (i.e. up and down the reflecting means 20) and if the pieces 30 are twisted this effect is enhanced by reflection at constantly changing angles in the horizontal plane (i.e. across the reflecting means from side to side). The result is an apparently random movement of the light. The means 18 for modifying light from the light source may have alternative constructions provided that an equivalent effect is achieved. For example, the means 18 may comprise pieces of reflective material such a pieces of glass or mirror tiles apparently randomly mounted on the outer surface of a rotatable cylinder so that light striking the glass or mirror pieces is reflected in an apparently random manner. Any of the reflecting components of the means 18 may be coloured in appropriate colours such as reds, greens, oranges and blues to enhance the appearance of the image in the viewing screen 22.

From the rear reflecting means 20, the light is reflected onto the viewing screen 22 to form a perceptible image. The viewing screen 22 has been removed in the view shown in FIG. 1. The rear reflecting means 20 may be an essentially planar sheet of material, or the sheet of material may be curved or uneven in shape. The whole surface of the sheet may be reflective, or only part thereof may be reflective. In a preferred arrangement, the rear reflecting means 20 comprises a sheet of material having reflective areas which are approximately flame shaped with the remainder of the sheet being essentially matte. The reflective areas may be formed from one or more cut-outs 20*a* of metal or other reflective material having the approximate shape of flames applied to an essentially matte front surface 20*b* of the sheet. The surface 20*b* may, for example be matte black. Alternatively, an essentially reflective sheet may have regions which are made matte by etching, painting or the like. Providing reflective areas in flame shape enhances the flame-like appearance of the image in the viewing screen 22. Other arrangements of the rear reflecting means are possible, provided that they do not lead to an increased depth of the overall fire. For example, the reflective means may comprise a reflective back sheet which reflects light from the light source 16 through a further sheet disposed in front of the back sheet, the further sheet having flame shaped apertures through which light passes after reflection by the back sheet.

The viewing screen 22 is preferably a planar glass screen but may be curved or may be formed from suitably optically transmissive plastics material. The viewing screen 22 is constructed to be partially diffusing of light and partially transmitting. Such screens are described in, for example GB 2 275 105. The partially diffusing nature of the screen enhances the flame like nature of the image which is viewable in the screen 22. In preferred arrangements, the front surface of the screen (as seen by a user) is made partially reflective so that the fuel bed 24 is reflected in the screen. In this way the image of the flames appears to emanate from the middle of a combined fuel bed comprising the fuel bed 24 and its reflection in the screen 22. Preferably the screen 22 is darkly tinted or "smoked" so that the internal components of the fire are not visible when the fire is not in use.

The choice of light source is an important feature of the flame simulating assembly of the present invention. Convention flame effect fires for mounting in a hearth or fireplace have used conventional incandescent light bulbs which have an approximate diameter of around 60 mm. In conventional fires, there is no practical restriction on the depth of the fire and so the size of the light source is not a problem. For mounting the fire directly on an essentially plane wall surface, the fire must be made slimmer (i.e. of a reduced depth) so that it does not penetrate too far into the room.

Accordingly the fire of the present invention uses, in one embodiment halogen bulbs which have a much smaller diameter of about 13-15 mm. Alternatively, the light source 16 may comprise one or more so-called "candle" bulbs which are usually tungsten filament bulbs having a narrower lateral dimension than conventional tungsten filament bulbs, typically not more than 40 mm, preferably not more that about 35 mm. The smaller size of these bulbs enables them to be mounted behind the means 18 for producing moving beams of light and achieves a significant space saving. Typically, two halogen bulbs or candle bulbs are used as the light source. In this specification, "halogen bulb" refers to halogen bulbs as such and to other bulbs of equivalent size, power and brightness or intensity. Halogen bulbs thus achieve an intensity of emitted light which is comparable to, or better than, a conventional incandescent bulb, but with a much reduced size. A typical halogen bulb suitable for use in the present invention has a power of 40 W to 60 W. An example is a bulb sold under the trade name "HALOPIN" by Osram. Halogen bulbs because of their brightness and intensity, together with the relative dispositions of the bulbs, the reflection means 20 and the means 18 have the added, and significant, unexpected benefit of achieving an improved flame effect as viewed in the screen 22. In particular, this arrangement provides an increased height of the flames which is especially beneficial when the simulated fuel is wooden logs.

In order to maximise the amount of light transmitted from the light source 16 to the fuel bed 24 and the viewing screen 22 (via the means 18) an additional reflector 21 may be mounted behind the light source. The additional reflector 21 is preferably plane but may possibly be non-planar, such as parabolic. The additional reflector may comprise a sheet of polished metal, a metallised plastic sheet or a mirror, for example. Provision of the additional reflector avoids the need for extra bulbs to achieve a given illumination, so avoiding adding to the dimensions and complexity of the apparatus. The additional reflector 21 may also allow the use of candle bulbs where otherwise a halogen bulb would be required, since the reflector is effective in maximising the amount of light from the light source which is transmitted to the means 18 for producing moving beams of light, the fuel bed 24 etc. This is especially important since the small depth of the fire of the invention necessarily constrains the size of the aperture through which light must pass in order to reach the rear reflector 20, after being reflected by the means 18. Clearly, the smaller the aperture, the more limited is the amount of light which can be transmitted and, at least potentially, the poorer the image in the screen 22 becomes.

A consequence of mounting the light source 16 behind the light modifying means 18 is that the means 18 obstructs access to the light source 16 for changing the light bulbs when, at the end of their life, they fail. The present invention overcomes this problem by making the means 18 displaceable so that access can be gained to the light source.

Figure 6:
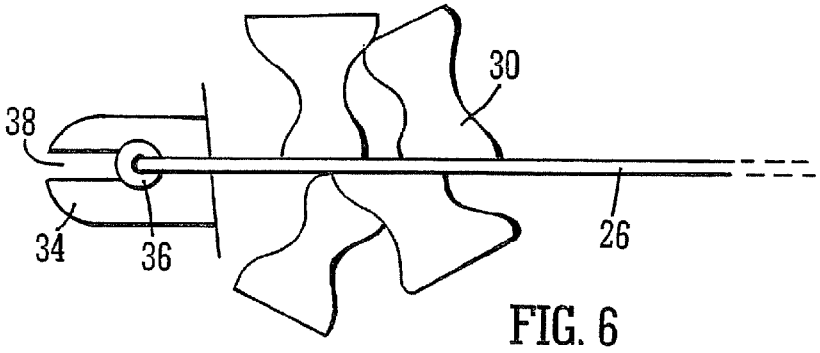
FIG. 6 illustrates in greater detail the means for producing moving beams of light.
Figure 7:
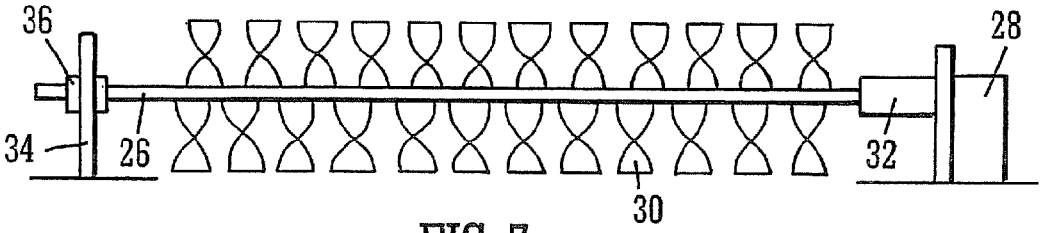
FIG. 7 shows a detail of the mounting of one end of the means for producing moving beams of light.
Figure 8:
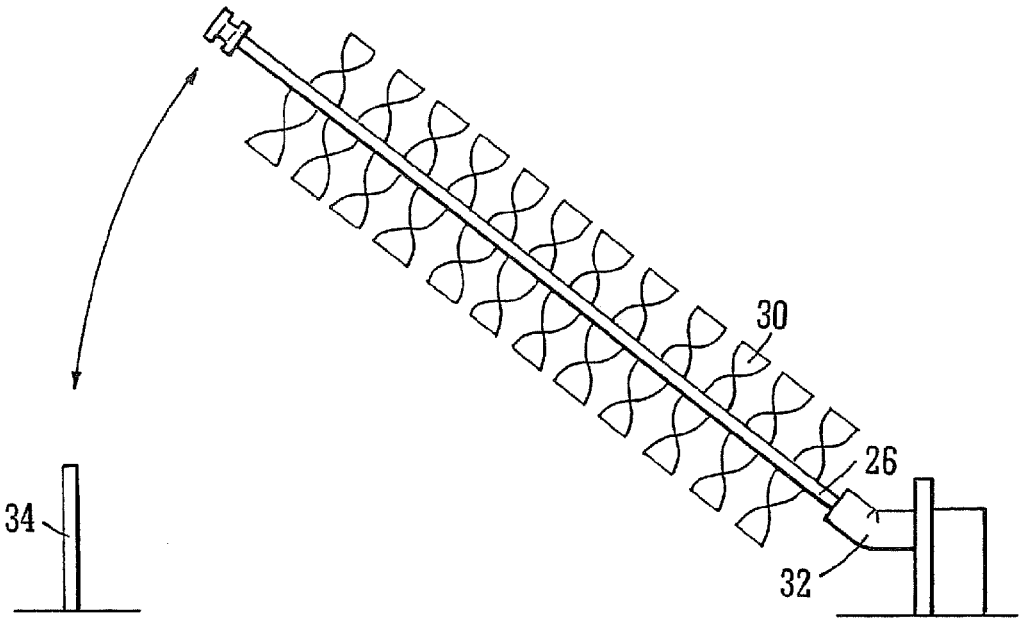
FIG. 8 shows the means for producing moving beams of light in its displaced position.

As can be seen in particular in FIGS. 6, 7 and 8, the shaft 26 of the means 18 is connected at a first end to a motor 28 so that drive is transferred from the motor 28 to the shaft 26 to rotate the shaft 26. The shaft 26 is connected to the motor 28 by means of a bushing 32. The bushing 32 is made from a rubber or other similarly flexible material. The other end of the shaft 26 is mounted in a bracket 34. A further bushing 36 may be provided. The bracket 34 includes a slot 38 through which the shaft 26 can be withdrawn to displace the means 18 from its use position. The slot 38 may be configured to retain the shaft 26 (via bushing 36) with a latching action. For example the leading part of the slot may be made slightly narrower than the width of the bushing 36 so that the bushing 36 and/or the bracket 34 must be slightly deformed to remove or insert the shaft 26 in the slot 38. On releasing the shaft 26 from the bracket 34, the bushing 32 is deformed to accommodate the movement of the shaft 26, as can be seen in FIG. 8. The bushing 32 allows the shaft to be moved until it is approximately perpendicular to its use position so that virtually unobstructed access can be gained to the light source 16.

Figure 2:
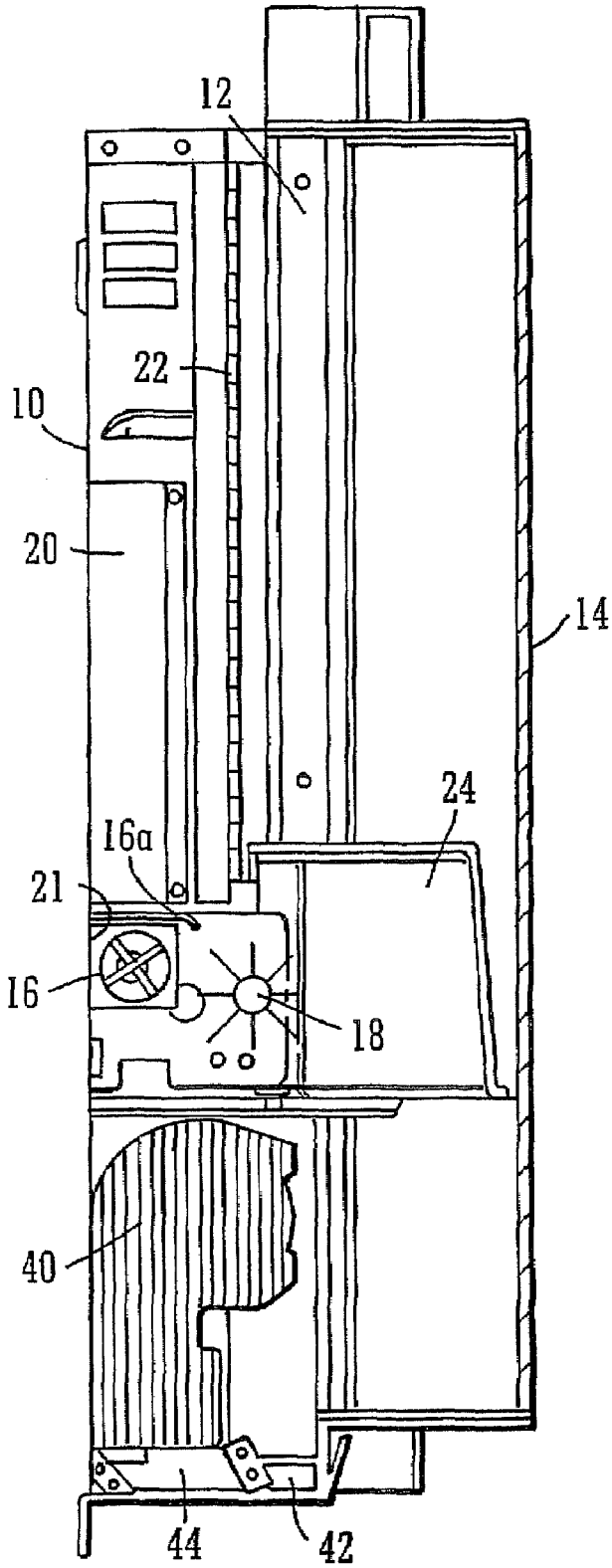
FIG. 2 is a section along the line A1-A1 of FIG. 1, but showing the complete fire.
Figure 3:
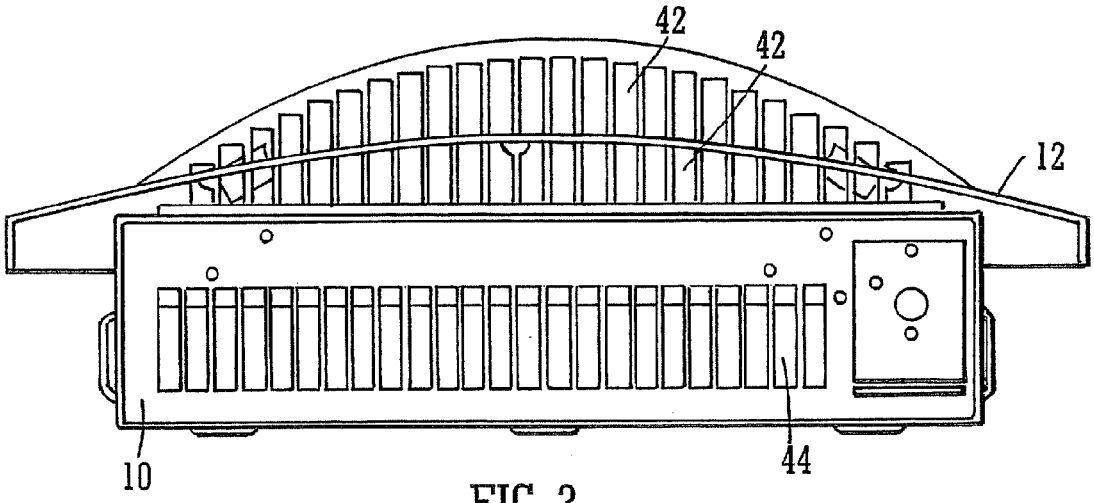
FIG. 3 is a plan view of one arrangement of the base of the housing of an assembled fire according to the invention.
Figure 4:
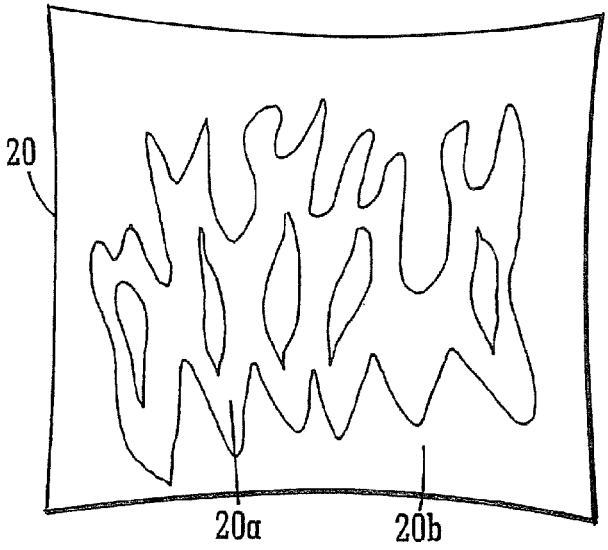
FIG. 4 is a top plan view of an assembled fire.
Figure 5:
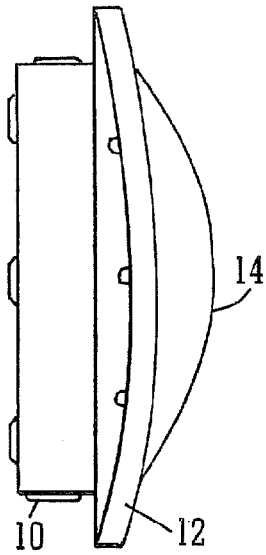
FIG. 5 is a schematic view of a reflecting means employed in the invention.

A further important feature of the fires according to the invention is the disposition of the heater. Conventional fires have mounted a fan heater in the fire housing, sometimes at the base so that the fan heater itself is arranged essentially horizontally and consequently the air heated by the fan heater, is expelled in an essentially horizontal flow. Sometimes the fan heater is arranged at the top of the housing so that the output of air heated by the fan heater, and the fan heater itself, are essentially horizontal or at most at about 45° to the horizontal. This arrangement is satisfactory where space is not restricted since a significant part of the depth of the fire is inset into the recess of the fireplace. However this arrangement is not satisfactory for a wall mounted fire as in the present invention since a fire of the depth required to accommodate a conventionally mounted heater would be obstructive and unattractive in use. Accordingly the inventors of the present invention have sought an alternative solution and have appreciated that because a wall mounted fire is not required to stand on a floor (such as a hearth), air can be drawn into and expelled from the housing of the fire through the base of the fire. The free space between the base of the fire and the floor when the fire is mounted on a wall provides adequate room for air circulation to provide effective and safe heating of a room. This arrangement allows the fan heater to be turned through about 90° compared with the position in a conventional fire so that the depth (front-to back dimension) occupied by the fan heater is considerably reduced and consequently providing a fire of considerably reduced depth. This arrangement can be seen especially in FIGS. 2 and 3 in which a fan or blower 40 draws air in through an aperture 42 formed in the base of the housing 10, heats the air and expels the heated air generally vertically downwardly through a second aperture 44 formed in the base of the housing 10. Preferably the front of the fan heater arrangement is protected by a suitable permanently fixed grill or safety guard 46 to prevent access to the fan heater arrangement while the shaft 26 is being displace to gain access to light source 16.

By means of the present invention a slim wall mountable fire is provided which provides a flame effect equivalent to, or better than a conventional fire while also providing effective heating by means of the fan heater arrangement. A conventional flame effect fire has a depth of the order of 300 mm or more. By the arrangements described above the present invention can provide a fire having a depth of 200 mm or less, preferably 180 mm or less.

The invention claimed is:

1. A flame effect electric fire comprising:

i) a housing having at least first and second opposing external side panels, a top external panel and an opposing bottom underside external panel, wherein the first side panel of the housing is adapted to be mounted on a substantially plane wall and the bottom underside external panel includes a horizontal portion;

ii) a fan heater disposed in the housing and configured to draw air into the housing, heat the air and expel the heated air; and iii) a flame simulating assembly mounted in the housing and comprising:

(a) a light source;

(b) a viewing screen on the second side panel capable of diffusing and transmitting light;

(c) a rear reflecting means disposed behind the viewing screen; and (d) means for producing moving beams of light, wherein the light source is disposed below the reflecting means and behind the viewing screen, the means for producing moving beams of light is disposed in front of the light source and below the screen and light from the light source is reflected by the means for producing moving beams of light onto the reflecting means and is reflected by the reflecting means onto the screen to produce a perceptible image viewable on the screen, and wherein the fan heater expels air in a generally vertically downward direction through an air expulsion aperture in the horizontal portion of the underside external panel of the housing.

2. A flame effect electric fire as claimed in claim 1 wherein the light source comprises at least one halogen bulb or tungsten filament bulb having a maximum external dimension of not more than about 40 mm.

3. A flame effect electric fire as claimed in claim 1 wherein light from the light source is prevented from falling directly onto the viewing screen by means of a baffle mounted above the light source.

4. A flame effect electric fire as claimed in claim 1 further comprising an additional reflector behind the light source.

5. A flame effective electric fire as claimed in claim 1 wherein the rear reflecting means has a concave reflecting surface.

6. A flame effect electric fire as claimed in claim 1 further comprising mounting means for mounting the flame effect fire on a wall.

7. A flame effect electric fire as claimed in claim 1 further comprising an air intake aperture in the underside external panel of the housing, wherein the heating means is configured to draw air into the housing through the air intake aperture in the underside external panel of the housing and to expel the heated air through the air expulsion aperture in the underside external panel of the housing.

8. A flame effect electric fire as claimed in claim 1, wherein the light source has a width of not more than about 35 mm.

9. A flame effect electric fire as claimed in claim 3 wherein the light source has a width of not more than about 15 mm.

10. A flame effect electric fire as claimed in claim 1 wherein the means for producing moving beams of light comprises a shaft mounted substantially horizontally for rotation about its axis, said shaft having a plurality of generally radially directed pieces of reflective material depending therefrom, said pieces being effective to reflect light from the light source onto the screen.

11. A flame effect electric fire as claimed in claim 10 wherein the shaft is driveably connected at a first end thereof via a flexible bushing to a drive means operative to rotate the shaft and is releasably retained at a second end thereof in a supporting bracket, the supporting bracket having a slot therein adjacent the second end of the shaft, the first end of the shaft being configured to be retained by the flexible bushing when the second end is released from the supporting bracket via the slot in the supporting bracket, and the shaft being displaceable from its operative position on release of its second end by flexure of the flexible bushing, thereby to permit access to the light source.

12. A flame effect electric fire as claimed in claim 1 wherein the rear reflecting means comprises a sheet of material having reflecting regions and non-reflecting regions.

13. A flame effect electric fire as claimed in claim 12 wherein the reflecting regions are generally flame shaped.

14. A flame effect electric fire as claimed in claim 1 further comprising a simulated fuel bed disposed directly in front of the diffusing and transmitting screen.

15. A flame effect electric fire as claimed in claim 14 wherein the screen comprises a reflective front surface configured such that a reflection of the fuel bed can be seen in the screen.

* * * * *